US009022754B2

(12) United States Patent
Chou

(10) Patent No.: US 9,022,754 B2
(45) Date of Patent: May 5, 2015

(54) FAN IMPELLER STRUCTURE

(75) Inventor: Chu-Hsien Chou, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 556 days.

(21) Appl. No.: 13/342,986

(22) Filed: Jan. 4, 2012

(65) Prior Publication Data

US 2013/0170967 A1 Jul. 4, 2013

(51) Int. Cl.

| | |
|---|---|
| ***F04D 29/58*** | (2006.01) |
| ***F04D 25/06*** | (2006.01) |
| ***F04D 25/08*** | (2006.01) |
| ***F04D 29/32*** | (2006.01) |

(52) U.S. Cl.

CPC ..... *F04D 25/0613* (2013.01); *F04D 25/082* (2013.01); *F04D 29/329* (2013.01)

(58) Field of Classification Search

USPC ..... 417/366, 423.8, 368; 310/63, 64, 61, 310/62; 415/116, 58.3, 58.4, 58.5, 58.7

See application file for complete search history.

(56) References Cited

U.S. PATENT DOCUMENTS

| | | | | |
|---|---|---|---|---|
| 3,449,605 | A * | 6/1969 | Wilson | 310/58 |
| 5,818,133 | A * | 10/1998 | Kershaw et al. | 310/67 R |
| 5,883,449 | A * | 3/1999 | Mehta et al. | 310/60 R |
| 6,773,239 | B2 * | 8/2004 | Huang et al. | 417/354 |
| 6,815,849 | B2 * | 11/2004 | Serizawa et al. | 310/62 |
| 7,034,417 | B1 * | 4/2006 | Liu | 310/60 A |
| 7,078,834 | B2 * | 7/2006 | Liu | 310/64 |
| 7,122,924 | B2 * | 10/2006 | Lee | 310/62 |
| 7,300,262 | B2 * | 11/2007 | Ku et al. | 417/366 |
| 7,616,440 | B2 * | 11/2009 | Franz | 361/695 |
| 2006/0170294 | A1 * | 8/2006 | Du | 310/63 |
| 2013/0011267 | A1 * | 1/2013 | Chou | 416/223 R |

* cited by examiner

*Primary Examiner* — Devon Kramer
*Assistant Examiner* — Nathan Zollinger
(74) *Attorney, Agent, or Firm* — C. G. Mersereau; Nikolai & Mersereau, P.A.

(57) ABSTRACT

A fan impeller structure includes an annular body. The annular body has a top section and a receiving space. At least one first bending section is formed between the top section and the annular body. At least one recess is formed at the first bending section. At least one flow guide hole is formed between the first bending section and the recess in communication with the receiving space. In operation, the airflow conducted into the receiving space is increased. Moreover, no matter whether the fan impeller structure is clockwise rotated or counterclockwise rotated, the airflow can be conducted into the receiving space through the flow guide hole. Accordingly, the heat dissipation effect will not be affected by the rotational direction of the fan impeller structure.

9 Claims, 11 Drawing Sheets

FAN IMPELLER STRUCTURE

BACKGROUND OF THE INVENTION

1. Field of the Invention

The present invention relates generally to a fan impeller structure, and more particularly to a fan impeller structure in which the airflow conducted into the receiving space is increased to enhance the heat dissipation effect. Moreover, no matter whether the fan impeller structure is clockwise rotated or counterclockwise rotated, the airflow can be conducted into the receiving space without being affected by the rotational direction of the fan impeller structure.

2. Description of the Related Art

Following the rapid development of electronic industries, the performances of all kinds of electronic components have been greatly promoted to have faster and faster processing speed. Also, the internal chipset of an electronic component contains more and more chips. The chips work at high speed and generate high heat at the same time. The heat must be efficiently dissipated outward. Otherwise, the performances of the electronic component will be greatly affected to slow down the processing speed of the electronic component. In some more serious cases, the electronic component may even burn out due to overheating. Therefore, heat dissipation has become a critical issue for all kinds of electronic components. A cooling fan is often used as a heat dissipation device for the electronic components.

A conventional cooling fan includes a hub and blades. Multiple coils and electronic components are received in the hub. The blades extend from the circumference of the hub. The diameter and size of the blades relate to the wind power of the cooling fan. The cooling fan is operated by means of the induction between the coils and the electronic components received in the hub. The coils and electronic components will generate heat in operation. It is an important issue how to dissipate the heat generated by the coils and the electronic components.

FIG. 1A is a perspective view of a conventional fan impeller structure. FIG. 1B is a sectional view of the conventional fan impeller structure. The fan impeller structure 1 includes a circumferential wall section 11 and a top section 12 positioned at a top end of the circumferential wall section 11. The top section 12 is formed with multiple through holes 121 and a central hole 122. A motor set 13 is disposed in the circumferential wall section 11. A shaft rod 14 is fitted in the central hole 122. The motor set 13 includes multiple coils 131 and electronic components 132.

By means of the motor set 13, the fan impeller structure 1 can be rotated around the axis of the shaft rod 14. At this time, the coils 131 and electronic components 132 of the motor set 13 generate heat. After a period of operation, the coils 131 and electronic components 132 tend to damage due to overheating. This will shorten the lifetime of the cooling fan. As aforesaid, the top section 12 of the fan impeller structure 1 is formed with multiple through holes 121. When the fan impeller structure 1 operates, some airflow can be conducted through the through holes 121 to the motor set 13 to lower the temperature thereof. However, the airflow cannot be effectively conducted through the through holes 121 to the motor set 13. Therefore, the heat dissipation effect for the motor set 13 is poor. As a result, the motor set 13 is likely to damage due to overheating. This will shorten the lifetime of the cooling fan. Therefore, the conventional fan impeller structure has the following defects:

1. The airflow cannot be effectively conducted.
2. The heat dissipation effect for the motor set is poor.

3. The motor set is likely to damage due to overheating to shorten the lifetime of the cooling fan.

SUMMARY OF THE INVENTION

A primary object of the present invention is to provide a fan impeller structure in which the airflow conducted into the receiving space is increased to enhance the heat dissipation effect.

A further object of the present invention is to provide the above fan impeller structure in which the heat dissipation effect is not affected by the rotational direction of the fan impeller structure.

To achieve the above and other objects, the fan impeller structure of the present invention includes an annular body. The annular body has a top section extending from one end of the annular body. The annular body has an internal receiving space. At least one first bending section is formed between the top section and the annular body. At least one recess is formed at the first bending section. At least one flow guide hole is formed between the first bending section and the recess in communication with the receiving space. When a motor set operates, the fan impeller structure is driven to rotate around the axis of a shaft rod. At this time, airflow is forcedly conducted through the flow guide hole into the receiving space to dissipate the heat generated by the motor set. The flow guide hole is formed at the first bending section in communication with the recess and the receiving space. Therefore, in operation, the airflow conducted into the receiving space is increased so that the temperature of the motor set can be effectively lowered to prolong the lifetime of the motor set. Moreover, no matter whether the fan impeller structure is clockwise rotated or counterclockwise rotated, the airflow can be conducted into the receiving space through the flow guide hole. Accordingly, the heat dissipation effect will not be affected by the rotational direction of the fan impeller structure.

According to the above, the present invention has the following advantages:

1. The airflow can be effectively conducted into the receiving space.
2. The heat dissipation effect for the motor set is enhanced.
3. The lifetime of the motor set is prolonged.
4. The heat dissipation effect will not be affected by the rotational direction of the fan impeller structure.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
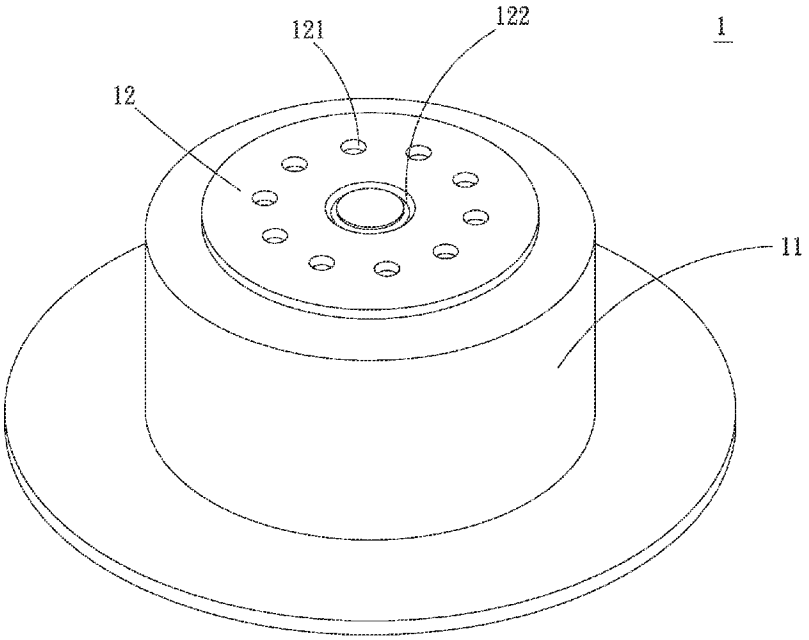
(PRIOR ART) Fig.1A
FIG. 1A is a perspective view of a conventional fan impeller structure.
Figure 1B:
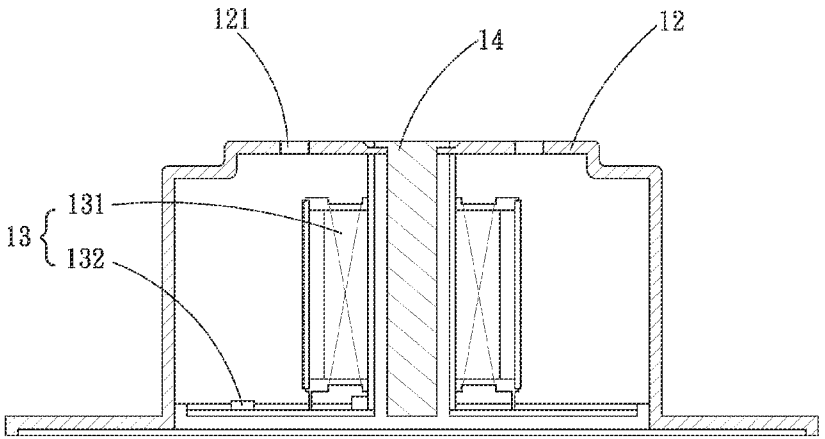
(PRIOR ART) Fig.1B
FIG. 1B is a sectional view of the conventional fan impeller structure.
Figure 2A:
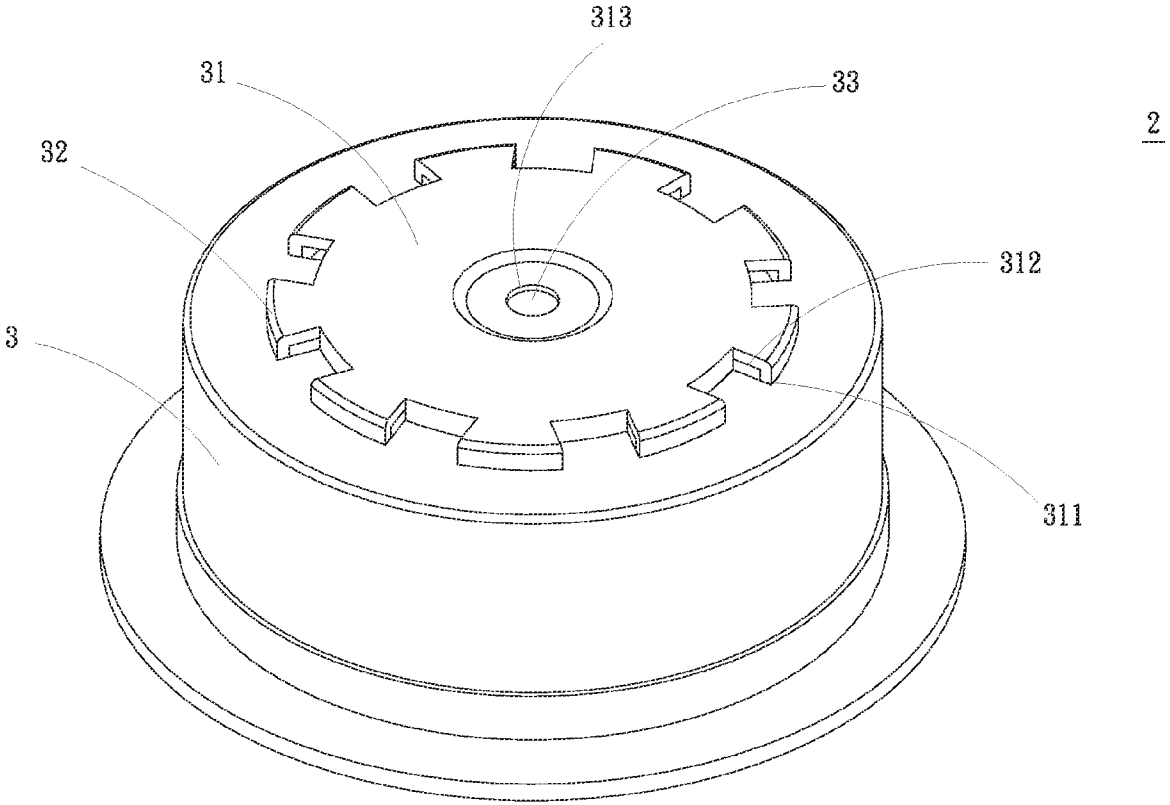
FIG. 2A is a perspective view of a first embodiment of the fan impeller structure of the present invention.
Figure 2B:
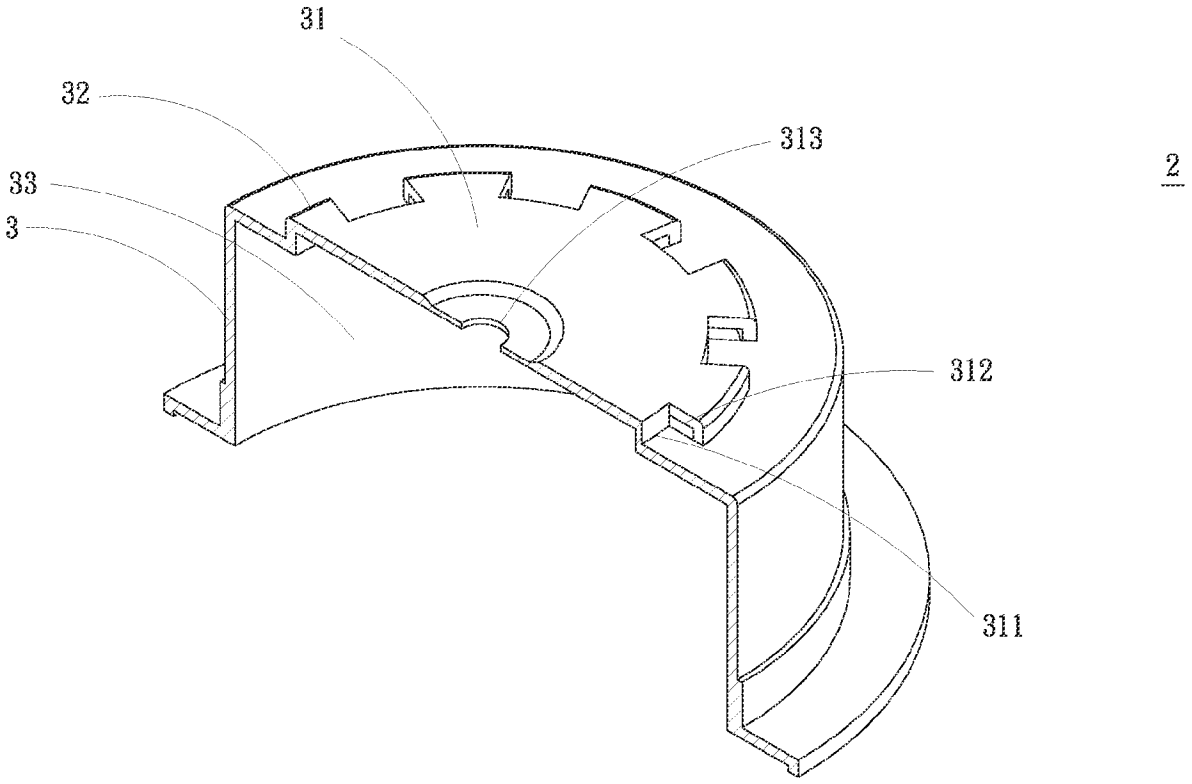
FIG. 2B is a sectional view of the first embodiment of the fan impeller structure of the present invention

Please refer to FIGS. 2A and 2B. FIG. 2A is a perspective view of a first embodiment of the fan impeller structure of the present invention. FIG. 2B is a sectional view of the first embodiment of the fan impeller structure of the present invention. According to the first embodiment, the fan impeller structure 2 includes an annular body 3. The annular body 3 has a top section 31. Multiple first bending sections 32 are formed between the top section 31 and the annular body 3. The annular body 3, the top section 31 and the first bending sections 32 are integrally connected to define an internal receiving space 33. The top section 31 has at least one recess 311 formed at the first bending sections 32. At least one flow guide hole 312 is formed between the first bending sections 32 and the recess 311 in communication with the recess 311 and the receiving space 33. The top section 31 is formed with a central shaft hole 313.

In this embodiment, the annular body 3 and the top section 31 of the fan impeller structure 2 are integrally made of metal material or plastic material. The first bending sections 32, the recess 311 and the flow guide hole 312 are formed by means of a measure selected from the group consisting of injection molding, casting, and pressing.

Figure 3:
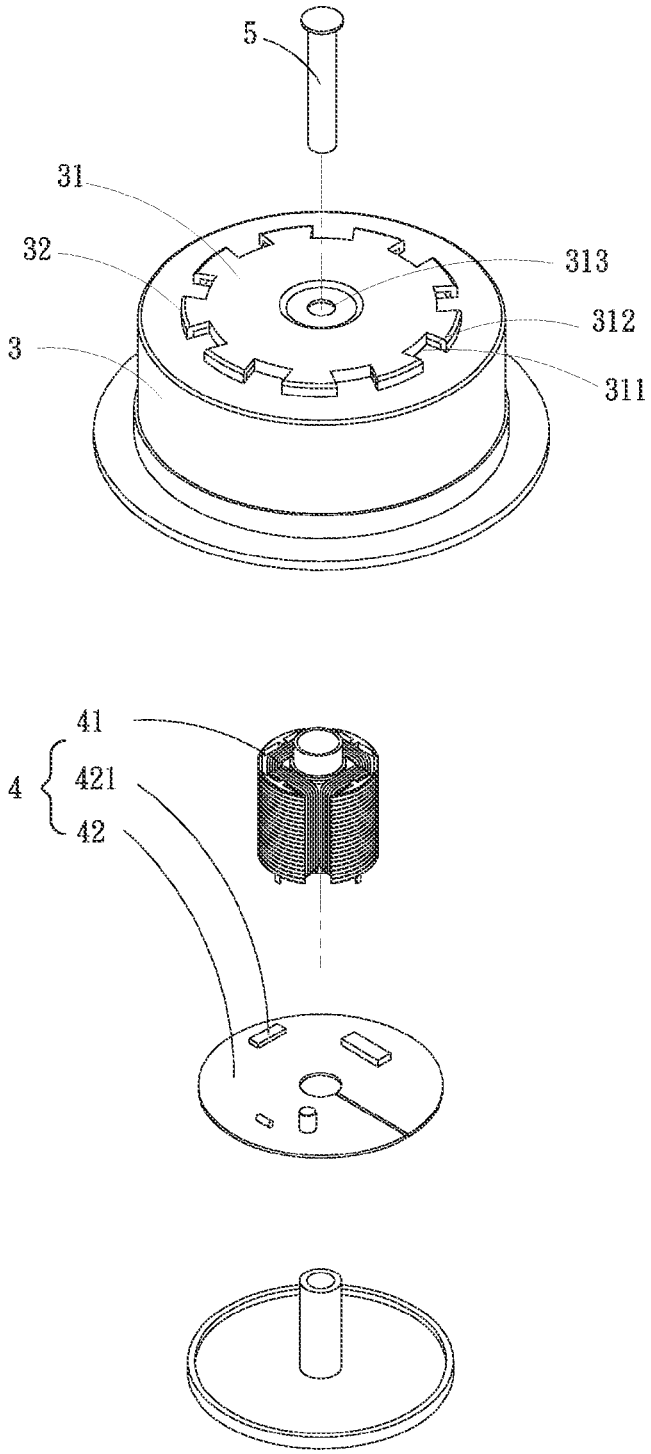
FIG. 3 is a perspective view showing that the first embodiment of the fan impeller structure of the present invention is applied to a motor set.

Please refer to FIGS. 2A, 2B and 3. FIG. 3 is a perspective view showing that the first embodiment of the fan impeller structure of the present invention is applied to a motor set 4. The motor set 4 is disposed in the receiving space 33. The motor set 4 includes multiple coils 41 and a control circuit 42. Multiple electronic components 421 are disposed on the control circuit 42. A shaft rod 5 is fitted through the shaft hole 313. When the motor set 4 operates, the annular body 3 and the top section 31 are driven to rotate around the axis of the shaft rod 5. At this time, the coils 41 and the electronic components 421 of the motor set 4 generate heat. When the annular body 3 and the top section 31 operate, airflow is conducted through the flow guide hole 312 into the receiving space 33 to dissipate the heat generated by the motor set 4. The flow guide hole 312 is formed at the first bending sections 32 in communication with the recess 311 and the receiving space 33. Therefore, in operation, the airflow conducted into the receiving space 33 is increased so that the temperature of the motor set 4 can be effectively lowered to prolong the lifetime of the motor set 4. Moreover, no matter whether the fan impeller structure 2 is clockwise rotated or counterclockwise rotated, the airflow can be conducted into the receiving space 33 through the flow guide hole 312. Accordingly, the heat dissipation effect will not be affected by the rotational direction of the fan impeller structure 2.

Figure 4A:
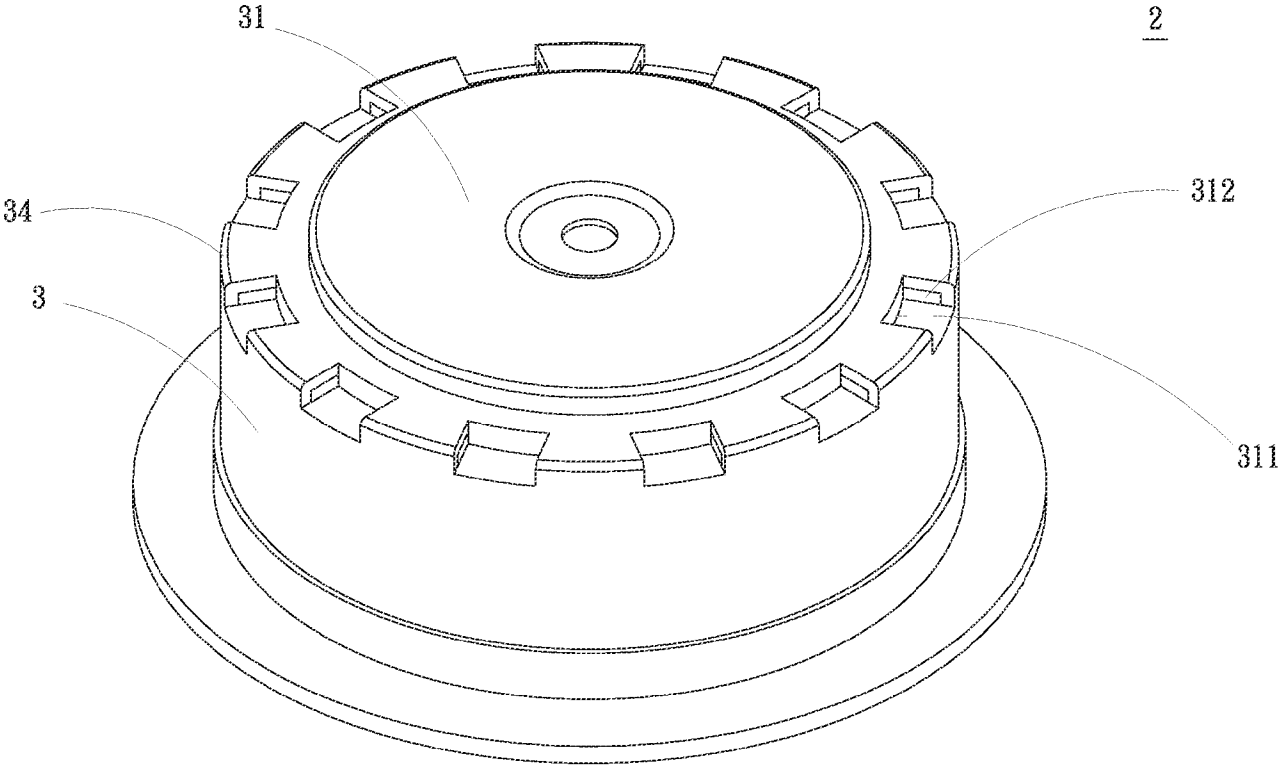
FIG. 4A is a perspective view of a second embodiment of the fan impeller structure of the present invention.
Figure 4B:
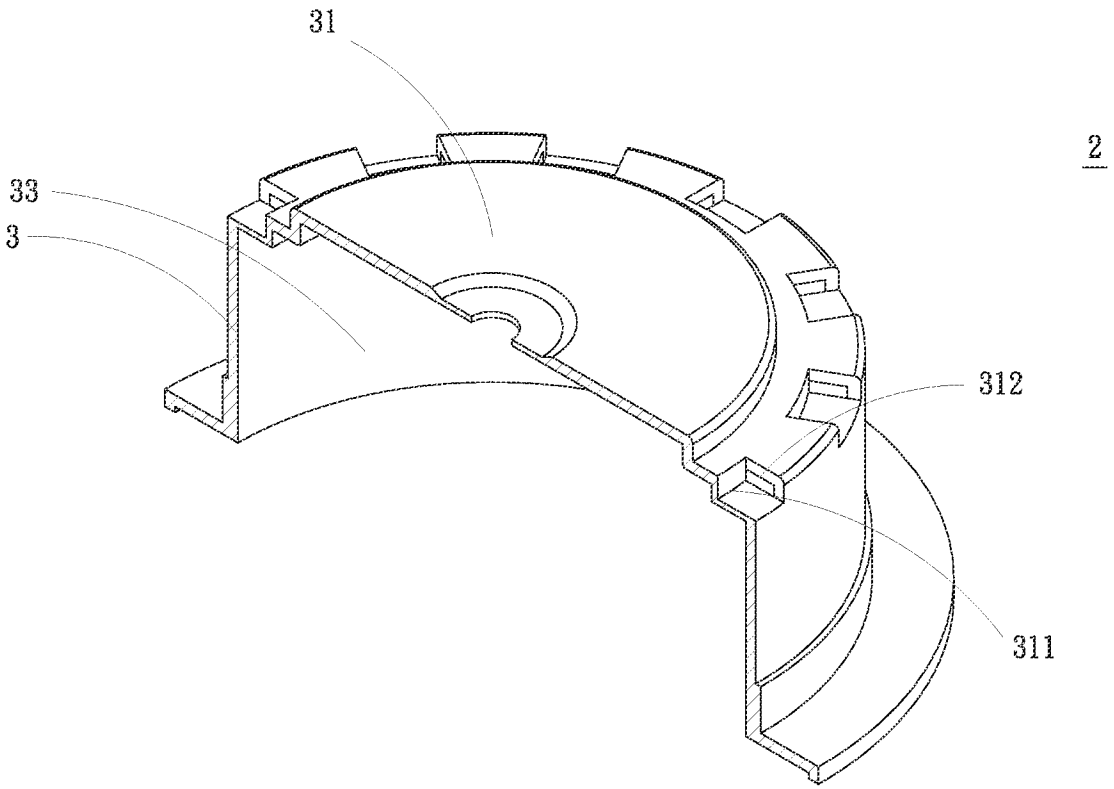
FIG. 4B is a sectional view of the second embodiment of the fan impeller structure of the present invention.

Please refer to FIGS. 4A and 4B. FIG. 4A is a perspective view of a second embodiment of the fan impeller structure of the present invention. FIG. 4B is a sectional view of the second embodiment of the fan impeller structure of the present invention. The second embodiment is substantially identical to the first embodiment in component, connection relationship and operation and thus will not be repeatedly described hereinafter. The second embodiment is different from the first embodiment in that multiple second bending sections 34 are further formed between the top section 31 and the annular body 3. The recess 311 is formed at the second bending sections 34. The flow guide hole 312 is formed between the second bending sections 34 and the recess 311 in communication with the recess 311 and the receiving space 33. The flow guide hole 312 is formed at the second bending sections 34 in communication with the recess 311 and the receiving space 33. Therefore, in operation of the annular body 3 and the top section 31, the airflow conducted into the receiving space 33 is increased. Moreover, no matter whether the fan impeller structure 2 is clockwise rotated or counterclockwise rotated, the airflow can be conducted into the receiving space 33 through the flow guide hole 312. Accordingly, the heat dissipation effect will not be affected by the rotational direction of the fan impeller structure 2.

Figure 5A:
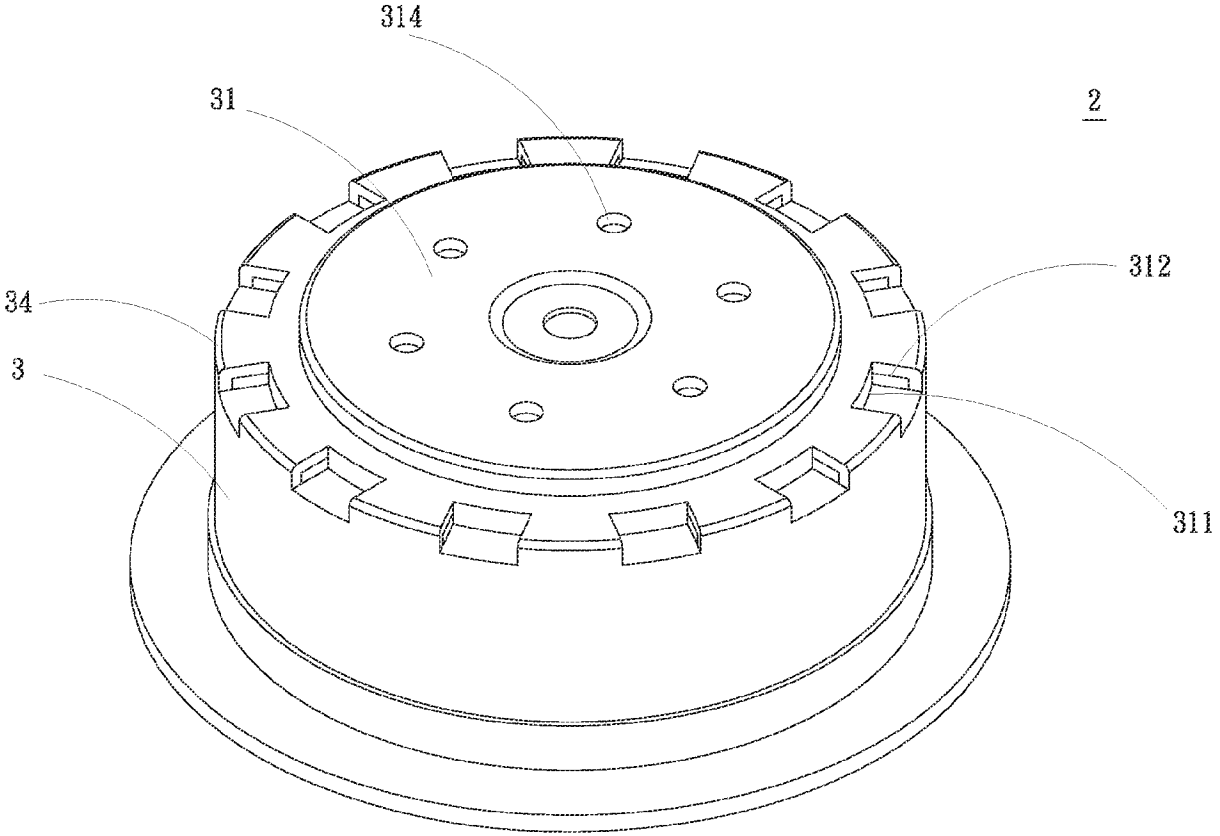
FIG. 5A is a perspective view of a third embodiment of the fan impeller structure of the present invention.
Figure 5B:
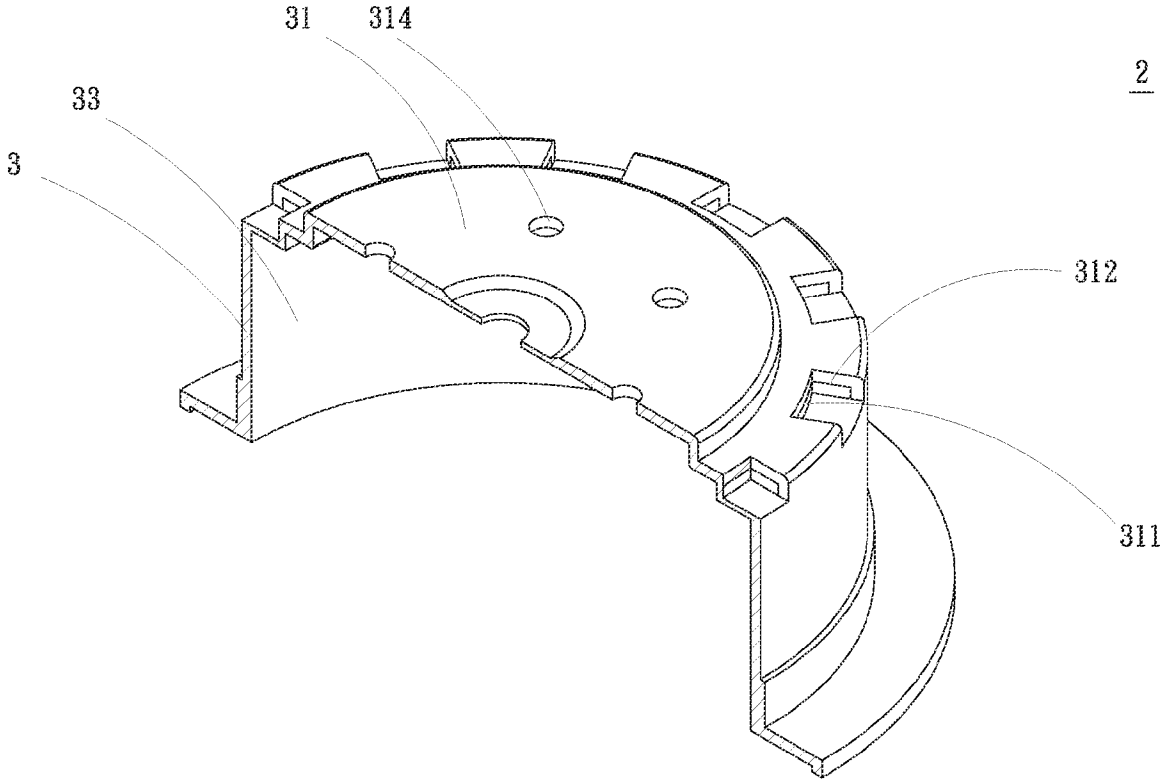
FIG. 5B is a sectional view of the third embodiment of the fan impeller structure of the present invention.

Please refer to FIGS. 5A and 5B. FIG. 5A is a perspective view of a third embodiment of the fan impeller structure of the present invention. FIG. 5B is a sectional view of the third embodiment of the fan impeller structure of the present invention. The third embodiment is substantially identical to the first and second embodiments in component, connection relationship and operation and thus will not be repeatedly described hereinafter. The third embodiment is different from, for example, the second embodiment in that multiple through holes 314 are formed on the top section 31 in communication with the receiving space 33. The recess 311 is formed at the second bending sections 34. The flow guide hole 312 is formed between the second bending sections 34 and the recess 311 in communication with the recess 311 and the receiving space 33. In operation of the annular body 3 and the top section 31, the airflow conducted into the receiving space 33 is increased. Moreover, no matter whether the fan impeller structure 2 is clockwise rotated or counterclockwise rotated, the airflow can be conducted into the receiving space 33 through the flow guide hole 312. Accordingly, the heat dissipation effect will not be affected by the rotational direction of the fan impeller structure 2.

Figure 6A:
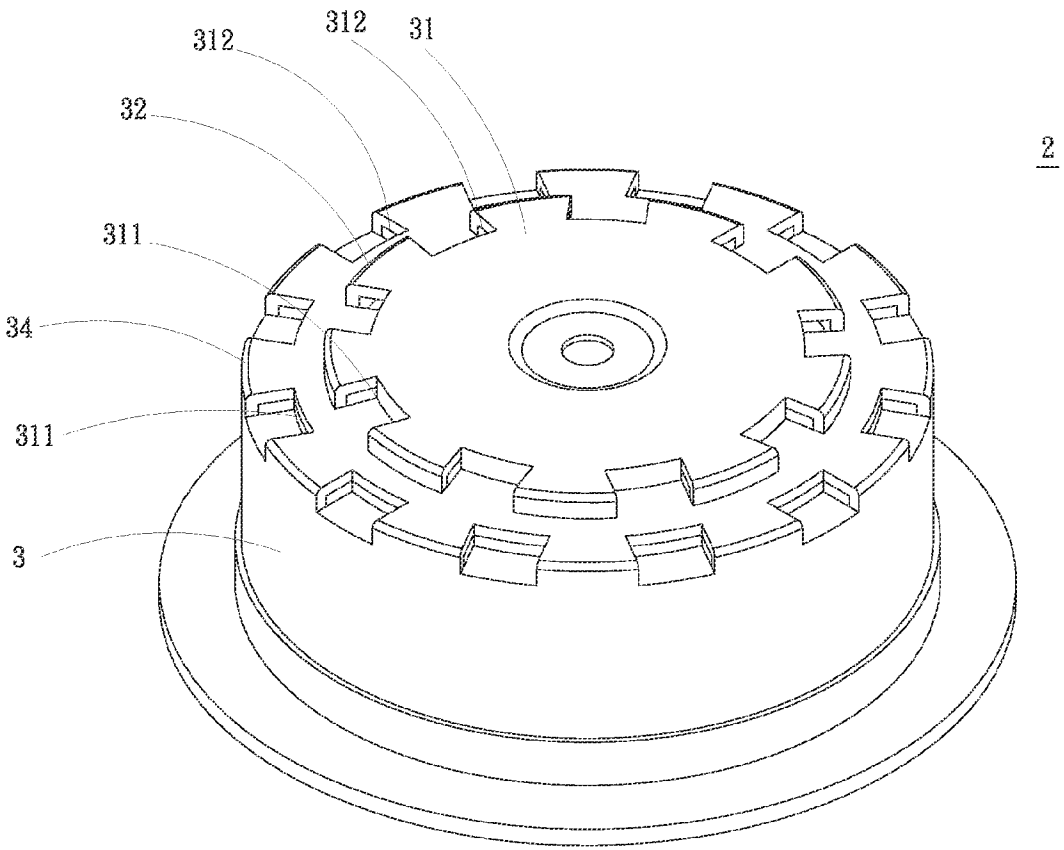
FIG. 6A is a perspective view of a fourth embodiment of the fan impeller structure of the present invention.
Figure 6B:
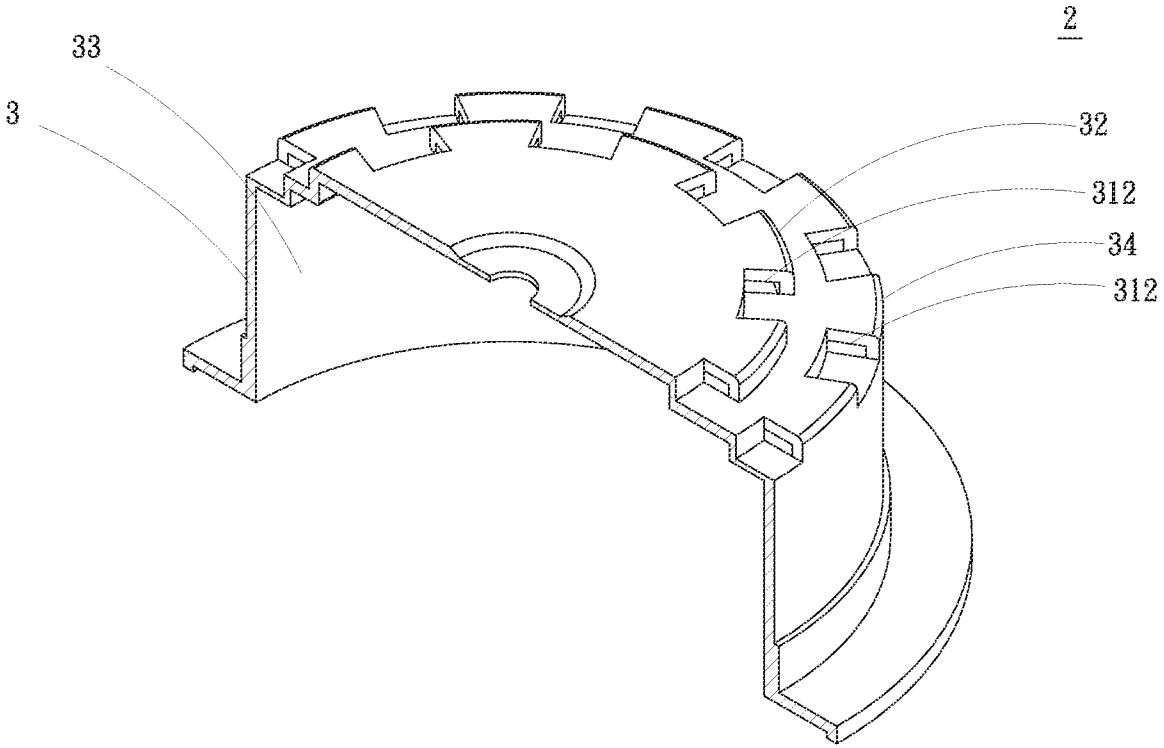
FIG. 6B is a sectional view of the fourth embodiment of the fan impeller structure of the present invention.

Please refer to FIGS. 6A and 6B. FIG. 6A is a perspective view of a fourth embodiment of the fan impeller structure of the present invention. FIG. 6B is a sectional view of the fourth embodiment of the fan impeller structure of the present invention. The fourth embodiment is substantially identical to the above embodiments in component, connection relationship and operation and thus will not be repeatedly described hereinafter. The fourth embodiment is different from the above embodiments in that recesses 311 are formed at both the first and second bending sections, 32, 34. Flow guide holes 312 are formed at both the first and second bending sections 32, 34 in communication with the recesses 311 and the receiving space 33. In operation of the annular body 3 and the top section 31, the airflow conducted into the receiving space 33 is increased. Moreover, no matter whether the fan impeller structure 2 is clockwise rotated or counterclockwise rotated, the airflow can be conducted into the receiving space 33 through the flow guide hole 312. Accordingly, the heat dissipation effect will not be affected by the rotational direction of the fan impeller structure 2.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. A fan impeller structure comprising an annular body which rotates around an axis, the annular body having a top section extending from one end of the annular body, a plurality of radially spaced first bending sections formed between the top section and the annular body, the top section having a plurality of recesses formed between consecutive first bending sections, a plurality of flow guide holes formed between the first bending sections and the recesses;

wherein a plurality of radially spaced second bending sections are further formed between the top section and the annular body; wherein additional recesses of the top section are formed between consecutive second bending sections, and additional flow guide holes are formed between the second bending sections and the additional recesses; and wherein the first bending sections are arranged closer to the axis than the second bending sections.

2. The fan impeller structure as claimed in claim 1, wherein the annular body has a receiving space in which a motor set is disposed, the motor set including multiple coils and a control circuit, multiple electronic components being disposed on the control circuit.

3. The fan impeller structure as claimed in claim 2, wherein each flow guide hole communicates with the receiving space.

4. The fan impeller structure as claimed in claim 2, wherein the top section is formed with multiple through holes that communicate with the receiving space.

5. The fan impeller structure as claimed in claim 1, wherein the first bending sections, the recesses and the flow guide holes are formed by means of a measure selected from the group consisting of injection molding, casting, and pressing.

6. The fan impeller structure as claimed in claim 1, wherein all bending sections, recesses and flow guide holes are formed by means of a measure selected from the group consisting of injection molding, casting, and pressing.

7. The fan impeller structure as claimed in claim 1, wherein the annular body is made of metal material or plastic material.

8. The fan impeller structure as claimed in claim 1, wherein the top section is formed with a central shaft hole.

9. The fan impeller structure as claimed in claim 1, wherein all flow guide holes communicate with the receiving space.

* * * * *